US008322559B2

(12) United States Patent
Kuzelka

(10) Patent No.: US 8,322,559 B2
(45) Date of Patent: Dec. 4, 2012

(54) DRUM WITH SIDEWALL THREADED TO PLASTIC BASE OR CHIME

(75) Inventor: Kenneth J. Kuzelka, Round Lake Beach, IL (US)

(73) Assignee: Michael D. Stolzman, Lake Forest, IL (US)

( * ) Notice: Subject to any disclaimer, the term of this patent is extended or adjusted under 35 U.S.C. 154(b) by 1448 days.

(21) Appl. No.: 11/974,950

(22) Filed: Oct. 17, 2007

(65) Prior Publication Data

US 2009/0101649 A1 Apr. 23, 2009

(51) Int. Cl.
*B65D 1/42* (2006.01)

(52) U.S. Cl. ..... 220/642; 220/288; 220/611; 220/612; 220/613

(58) Field of Classification Search ..... 220/288, 220/611, 613, 617, 654, 642, 298, 790
See application file for complete search history.

(56) References Cited

U.S. PATENT DOCUMENTS

| | | | | | |
|---|---|---|---|---|---|
| 2,356,401 | A | * | 8/1944 | Hatch | 229/5.5 |
| 3,101,857 | A | * | 8/1963 | Freedman | 215/396 |
| 3,454,207 | A | * | 7/1969 | Jackson | 229/5.84 |
| 3,470,929 | A | * | 10/1969 | Thornton | 220/233 |
| 3,734,393 | A | * | 5/1973 | Stump | 229/5.5 |
| 3,899,117 | A | * | 8/1975 | Peyser et al. | 229/5.5 |
| 3,912,154 | A | * | 10/1975 | Godar | 229/5.5 |
| 3,913,774 | A | * | 10/1975 | Vajtay | 220/4.01 |
| 4,014,723 | A | * | 3/1977 | Jones | 156/69 |
| 4,182,475 | A | * | 1/1980 | Freund | 229/5.7 |
| 4,183,457 | A | * | 1/1980 | Loughley et al. | 229/5.5 |
| 4,241,864 | A | * | 12/1980 | Kessler | 229/5.5 |
| 4,249,690 | A | * | 2/1981 | Held, Jr. | 229/5.5 |
| 4,252,265 | A | * | 2/1981 | Brundige et al. | 229/5.7 |
| 4,305,535 | A | * | 12/1981 | Brundige et al. | 229/5.7 |
| 4,346,832 | A | * | 8/1982 | Werner | 229/4.5 |
| 4,355,759 | A | * | 10/1982 | Amberg | 229/5.5 |
| 4,495,209 | A | * | 1/1985 | Whiteside | 426/392 |
| 4,500,010 | A | * | 2/1985 | Schutz | 220/320 |
| 4,560,063 | A | * | 12/1985 | Muller | 229/5.5 |
| 4,700,867 | A | | 10/1987 | Dutt et al. | |
| 4,757,936 | A | * | 7/1988 | Homma et al. | 229/5.5 |
| 4,762,249 | A | * | 8/1988 | Fortuna et al. | 220/359.4 |
| 5,012,970 | A | * | 5/1991 | Kucherer | 229/4.5 |
| 5,160,061 | A | * | 11/1992 | Stolzman | 220/359.4 |
| 5,190,209 | A | * | 3/1993 | Gordon et al. | 229/5.7 |
| 5,215,207 | A | * | 6/1993 | Stolzman | 220/359.4 |
| 5,259,526 | A | * | 11/1993 | Stolzman | 220/802 |

(Continued)

FOREIGN PATENT DOCUMENTS

| | | |
|---|---|---|
| GB | 2 331 068 | 5/1999 |

(Continued)

*Primary Examiner* — Anthony Stashick
*Assistant Examiner* — Christopher McKinley
(74) *Attorney, Agent, or Firm* — Wood, Phillips, Katz, Clark & Mortimer

(57) ABSTRACT

A shipping and storage drum comprises a unitary base of synthetic resin comprising a circular center wall connected at a peripheral edge to a connecting ring having an upwardly opening threaded annular channel. A tubular fiberboard sidewall defines a peripherally closed space having open opposite upper and lower ends. The tubular sidewall lower end is threaded into the threaded annular channel to close the sidewall lower end. The shipping and storage drum may also comprise a chime of synthetic resin comprising a connecting ring having a downwardly opening threaded annular channel receiving the upper end of the tubular sidewall, the chime for removably receiving a cover.

18 Claims, 3 Drawing Sheets

U.S. PATENT DOCUMENTS 5,452,748 A * 9/1995 Simmons et al. ..... 138/89
5,503,187 A * 4/1996 Simmons et al. ..... 138/89
5,676,406 A * 10/1997 Simmons et al. ..... 285/333
5,678,735 A * 10/1997 Guglielmini ..... 222/153.06
5,816,437 A * 10/1998 Lin ..... 220/611
6,019,240 A * 2/2000 Legeza ..... 220/321
6,056,143 A * 5/2000 Stolzman ..... 220/284
6,325,231 B1 12/2001 Ketting et al.
7,617,967 B2 * 11/2009 Koessendrup ..... 229/5.5

FOREIGN PATENT DOCUMENTS

WO WO 93/17920 8/1993

* cited by examiner 54
12
14
52
58
60
56
62
20
18
50

DRUM WITH SIDEWALL THREADED TO PLASTIC BASE OR CHIME

CROSS REFERENCE TO RELATED APPLICATIONS

There are no related applications.

FIELD OF THE INVENTION

This invention relates to containers and, more particularly, to a drum with a sidewall threaded to a plastic base or chime.

BACKGROUND OF THE INVENTION

In one form of conventional shipping and storage container, a tubular sidewall is formed of fibrous material or other material. Conventionally, metal retaining rings are provided at opposite ends of the sidewall for securing closure walls there across. Such metal retaining rings are relatively costly and heavy and are not fully satisfactory in the formation of a low cost shipping and storage container.

Ultimately, the container may be sent to, for example, an incinerator for destruction. If a metal retaining ring is used, then it is necessary to remove the metal from the incinerator.

Also, in the formation of such a prior container, a rolling operation is required to seal the retaining ring to the drum.

An alternative to such prior containers is described in U.S. Pat. No. 4,805,798, which discloses a container in the form of a tubular fiber sidewall having a connecting ring molded of synthetic resin in situ in association with an end portion of the sidewall. Such a container requires a die press adapted to support the sidewall while molding the connecting ring to the sidewall.

Other alternatives are disclosed in U.S. Pat. Nos. 5,160,061 and 5,215,207 which disclose a connecting ring adhered to a container sidewall by vibrational welding.

The present invention is directed to further improvements in shipping and storage containers.

SUMMARY OF THE INVENTION

In accordance with the invention, there is disclosed a drum with a sidewall threaded to a plastic base or chime.

Broadly, there is disclosed a shipping and storage drum comprising a unitary base of synthetic resin comprising a circular center wall connected at a peripheral edge to a connecting ring having an upwardly opening threaded annular channel. A tubular sidewall defines a peripherally closed space having an upper end and a lower end. The lower end of the tubular sidewall is threaded into the threaded annular channel to close the lower end of the sidewall.

In accordance with the invention, the shipping and storage drum may also comprise a chime of synthetic resin comprising a connecting ring having a downwardly opening threaded annular channel receiving the upper end of the tubular sidewall, the chime for removably receiving a cover.

It is a feature of the invention that the sidewall is a fiberboard sidewall.

It is another feature of the invention to provide a sealant disposed in the channel.

It is a further feature of the invention that the threaded annular channel comprises opposite facing inner and outer walls each having a continuous thread. The inner wall thread may be offset from the outer wall thread.

It is still another feature of the invention that the thread is triangular in cross-section.

It is still another feature of the invention that the drum has a diameter in the range of about 12 to 30 inches.

It is still a further feature of the invention that the annular channel has a thread extending at least two revolutions of the connecting ring.

There is disclosed in accordance with another aspect of the invention a shipping and storage drum comprising a unitary base of synthetic resin comprising a circular center wall connected at a peripheral edge to a connecting ring having an upwardly opening threaded annular channel. A tubular fiberboard sidewall defines a peripherally closed space having open opposite upper and lower ends. The tubular sidewall lower end is threaded into the threaded annular channel to close the sidewall lower end.

Further features and advantages of the invention will be readily apparent from the specification and from the drawings.

DETAILED DESCRIPTION OF THE INVENTION

Figure 1:
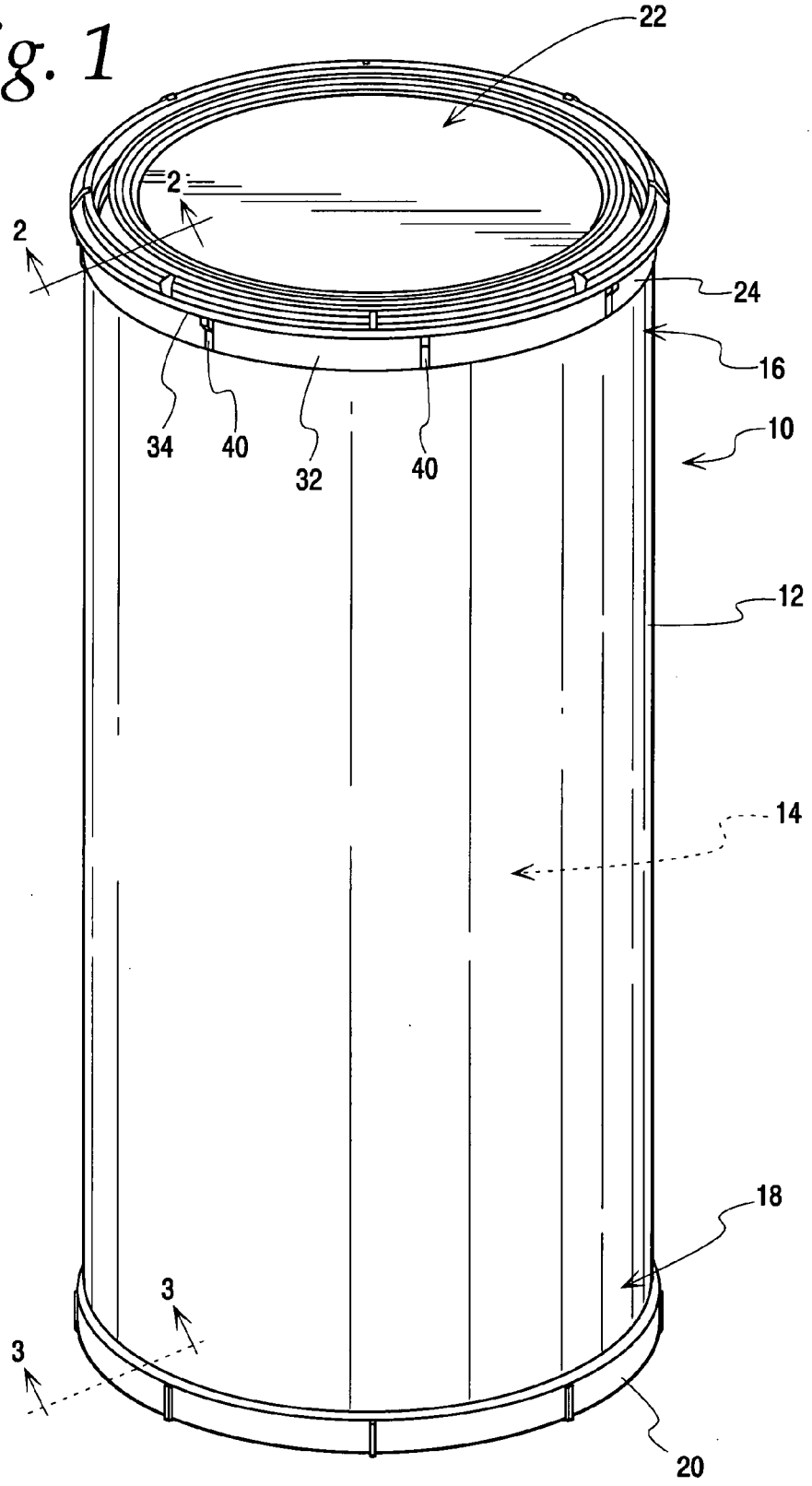
FIG. 1 is a perspective view of a shipping and storage drum in accordance with the invention.
Figure 2:
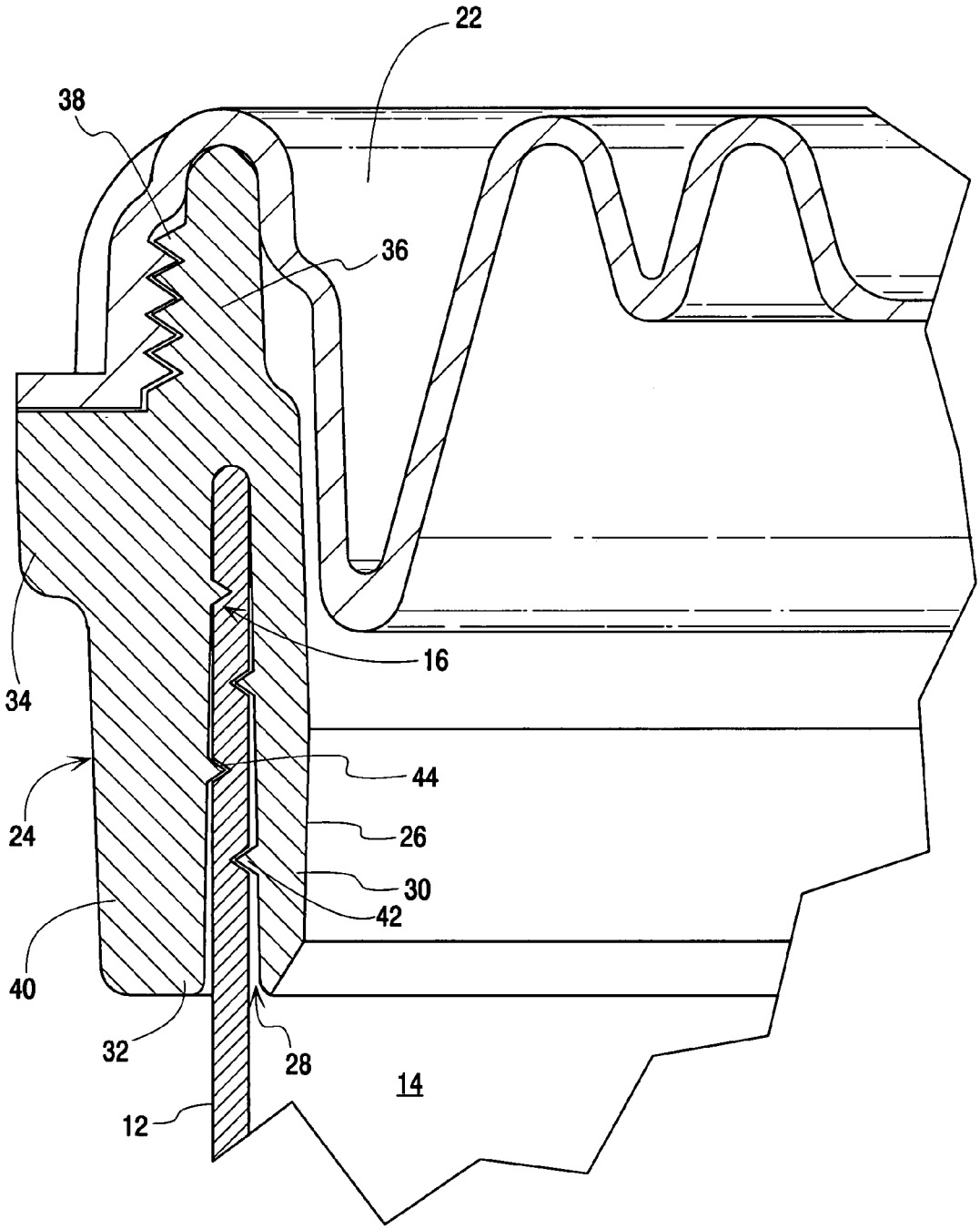
FIG. 2 is a partial, sectional view taken along the line 2-2 of FIG. 1.
Figure 3:
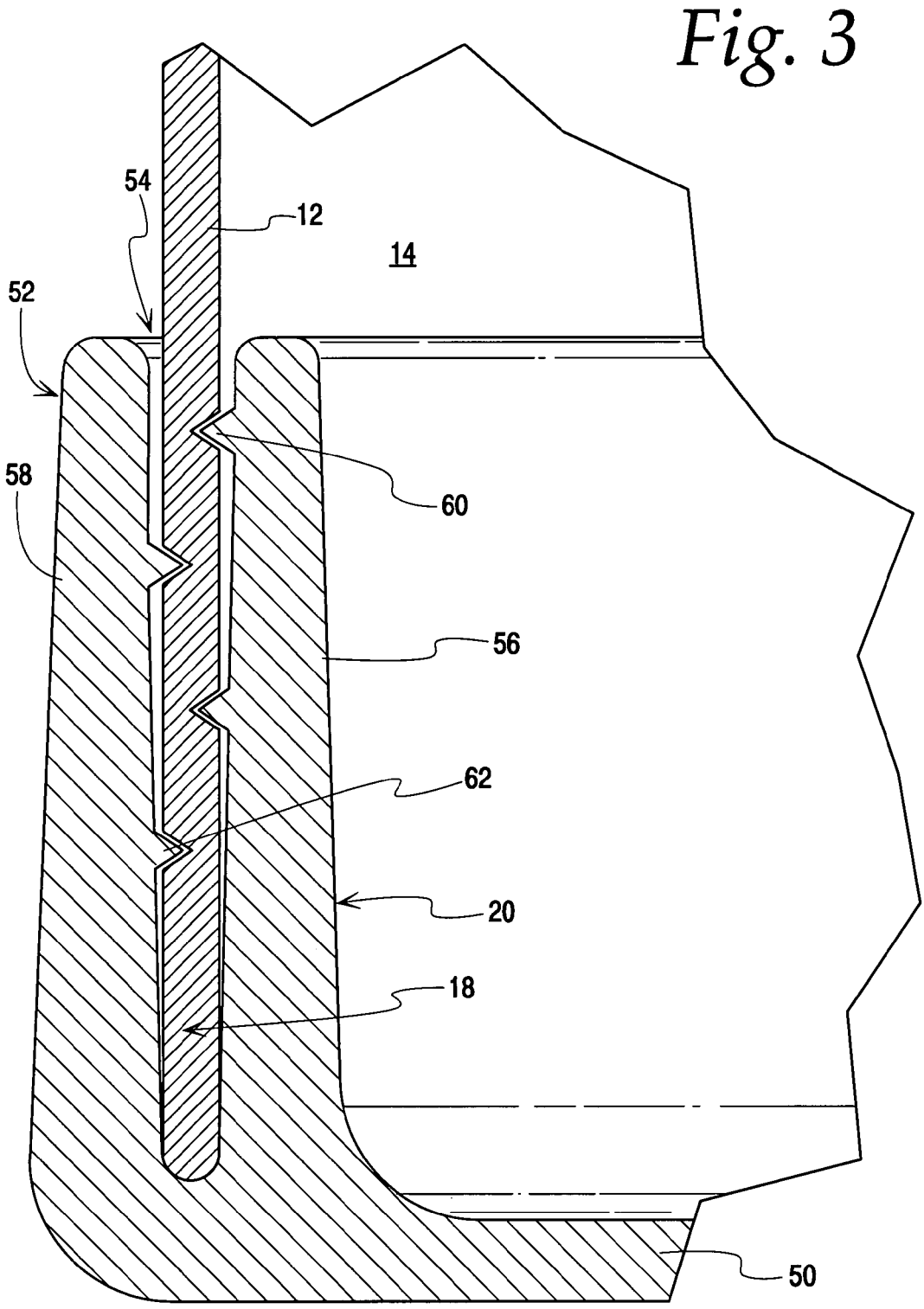
FIG. 3 is a sectional view taken along the line 3-3 of FIG. 1.

As illustrated in FIGS. 1-3 of the drawings, a container in the form of a shipping and storage drum 10 includes a fibrous tubular sidewall 12, such as fiberboard. The sidewall 12 defines a right cylinder defining a peripherally closed space 14 and having an upper end 16 and a lower end 18. The sidewall 12 is formed by rolling paper layers around a forming tube with an adhesive between layers to bond the layers.

The space 14 is closed at a lower end by a bottom closure or base 20 fixedly secured to the sidewall lower end 18, as described below. The upper end of the space 14 is selectively closed by a second closure comprising a cover 22 removably secured to a chime 24. The chime 24 is fixedly secured to the sidewall upper end 16, as described below. Particularly, in accordance with the invention, the connection of the sidewall 12 to the base 20 and chime 24 comprises a threaded connection.

Referring particularly to FIG. 2, the chime 24 comprises a connecting ring 26 having a downwardly opening annular channel 28 receiving the tubular sidewall upper end 16. The connecting ring 26 comprises an inner wall 30 spaced from an outer wall 32 facing one another in the channel 28. A flange 34 extends outwardly from a top end of the outer wall 32. An annular ring 36 extends upwardly above the channel 28. The annular ring 36 includes a threaded outer wall 38 for threadably receiving the cover 22 in a conventional manner. A plurality of support ribs 40 are spaced about the circumference of the outer wall 32 below the flange 34.

Although the chime 24 is illustrated including a threaded connection with the cover 22, the interconnection could be a self locking cover or use a locking band, as will be apparent.

In accordance with the invention, the connecting ring inner wall 30 includes an inner thread 42 disposed in the channel 28 facing the outer wall 32. Similarly, the outer wall 32 includes an outer thread 44 extending into the annular channel 28 facing the inner wall 30. The threads 42 and 44 are triangular in configuration to comprise a sharp thread. Each thread 42 and 44 extends about two revolutions of the annular channel 28 with the threads 42 and 44 being offset about 180° so that the threads of the inner thread 42 fall midway between threads of the outer thread 44, and vice versa, as is apparent.

The chime 24 is secured to the sidewall 12 by threading the sidewall 12 into the threaded annular channel 28. The threads 42 and 44 dig into the fiberboard sidewall 12 at the upper end 16. In the drawings, the channel 28 includes a draft for molding. However, the draft is somewhat exaggerated in the drawings.

A sealant of silicone or the like can be used to fill the channel 28, before or after threading, to create a water tight seal between the sidewall 12 and the chime 24.

Referring to FIG. 3, the base 20 comprises a circular center wall 50 connected at a peripheral edge to a connecting ring 52 having an upwardly opening annular channel 54. The connecting ring 52 comprises an inner wall 56 and an outer wall 58. The inner wall 56 includes an inner thread 60 in the annular channel 54 facing the outer wall 58. The outer wall 58 includes an outer thread 62 in the annular channel 54 facing the inner wall 56. The threads 60 and 62 are triangular in cross-section to comprise a sharp thread. The threads 60 and 62 are continuous and extend about two revolutions of the base 20 and are offset from one another, as with the threads of the chime 24, discussed above. The tubular sidewall lower end 18 is threaded into the annular channel 54 to close the lower end of the sidewall 18. As recited previously, a sealant could be used in the annular channel 54 before or after threading the sidewall 12 to the base 20.

In the illustrated embodiment of the invention, the drum 10 comprises a shipping and storage drum with the sidewall 12 having a diameter in the range of about 12 to 30 inches. The base 20 and chime 24 are molded of a synthetic resin, such as high density polyethylene.

Thus, in accordance with the invention, a drum 10 is provided consisting of two component elements, namely plastic and fiber. After the drum 10 has completed its useful life, the plastic and fiber parts can be separated and recycled, as necessary.

The drum provides positive securement of the chime 24 and base 20 to the sidewall 12 without having to mold the same directly thereon. Moreover, the securement is accomplished with a simple threading operation which is optionally supplemented with a sealant.

The disclosed embodiment of the invention is illustrative of the broad inventive concepts comprehended.

I claim:

1. A shipping and storage drum comprising:

a unitary base of synthetic resin comprising a circular center wall connected at a peripheral edge to a connecting ring having an upwardly opening threaded annular channel, wherein the threaded annular channel comprises opposite facing inner and outer walls each having a continuous thread; and a tubular sidewall defining a peripherally closed space having an upper end and a lower end, wherein the lower end of the tubular sidewall is threaded into the threaded annular channel to close the lower end of the sidewall.

2. The shipping and storage drum of claim 1 further comprising a chime of synthetic resin comprising a connecting ring having a downwardly opening threaded annular channel receiving the upper end of the tubular sidewall, the chime for removable receiving a cover.

3. The shipping and storage drum of claim 1 wherein the sidewall is a fiberboard sidewall.

4. The shipping and storage drum of claim 1 wherein the sidewall is formed of paper.

5. The shipping and storage drum of claim 1 further comprising a sealant disposed in the channel.

6. The shipping and storage drum of claim 1 wherein the inner wall thread is offset from the outer wall thread.

7. The shipping and storage drum of claim 1 wherein the thread is triangular in cross section.

8. The shipping and storage drum of claim 1 wherein the drum has a diameter in the range of about 12 to 30 inches.

9. The shipping and storage drum of claim 1 wherein the annular channel has a thread extending at least two revolutions of the connecting ring.

10. A shipping and storage drum comprising:

a unitary base of synthetic resin comprising a circular center wall connected at a peripheral edge to a connecting ring having an upwardly opening threaded annular channel, wherein the threaded annular channel comprises opposite facing inner and outer walls each having a continuous thread; and a tubular fiberboard sidewall defining a peripherally closed space having open opposite upper and lower ends, wherein the tubular sidewall lower end is threaded into the threaded annular channel to close the sidewall lower end.

11. The shipping and storage drum of claim 10 further comprising a chime of synthetic resin comprising a connecting ring having a downwardly opening threaded annular channel receiving the upper end of the tubular sidewall, the chime for removable receiving a cover.

12. The shipping and storage drum of claim 10 wherein the sidewall is a fiberboard sidewall.

13. The shipping and storage drum of claim 10 wherein the sidewall is formed of paper.

14. The shipping and storage drum of claim 10 further comprising a sealant disposed in the channel.

15. The shipping and storage drum of claim 10 wherein the inner wall thread is offset from the outer wall thread.

16. The shipping and storage drum of claim 10 wherein the tread is triangular in cross section.

17. The shipping and storage drum of claim 10 wherein the drum has a diameter in the range of about 12 to 30 inches.

18. The shipping and storage drum of claim 10 wherein the annular channel has a thread extending at least two revolutions of the connecting ring.

* * * * *